US007083243B2

(12) United States Patent
Lee

(10) Patent No.: US 7,083,243 B2
(45) Date of Patent: Aug. 1, 2006

(54) SELF-CLOSING AND OPENING PREVENTING DEVICE FOR SLIDE RAILS

(75) Inventor: Myeong-Cheol Lee, Seoul (KR)

(73) Assignee: Juyoung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 10/959,790

(22) Filed: Oct. 6, 2004

(65) Prior Publication Data

US 2006/0043851 A1 Mar. 2, 2006

(30) Foreign Application Priority Data

Aug. 30, 2004 (KR) ..... 10-2004-0068415

(51) Int. Cl.
*A47B 88/00* (2006.01)

(52) U.S. Cl. ..... 312/333; 312/319.1; 312/334.47

(58) Field of Classification Search ..... 312/319.1, 312/333, 334.44, 334.46, 334.47; 384/21
See application file for complete search history.

(56) References Cited

U.S. PATENT DOCUMENTS 5,169,238 A * 12/1992 Schenk ..... 384/21
5,356,207 A * 10/1994 Rock et al. ..... 312/334.46
6,145,944 A 11/2000 Bayani et al.
6,733,097 B1 5/2004 Kim et al.
6,799,817 B1 * 10/2004 Chu ..... 312/333
6,883,884 B1 * 4/2005 Chen et al. ..... 312/333
2004/0183411 A1 * 9/2004 Boks ..... 312/333
2004/0227438 A1 * 11/2004 Tseng et al. ..... 312/333
2005/0093406 A1 * 5/2005 Yang ..... 312/333
2005/0104492 A1 * 5/2005 Chiu ..... 312/333

FOREIGN PATENT DOCUMENTS

EP 391221 * 10/1990

* cited by examiner

*Primary Examiner*—Lanna Mai
*Assistant Examiner*—Hanh V. Tran
(74) *Attorney, Agent, or Firm*—Darby & Darby

(57) ABSTRACT

A self-closing and opening preventing device for slide rails of a drawer includes a housing fixed on the rear inside of a fixing rail with engaging holes on its front upper and lower positions and a long pin guiding groove on its central part. A cam slider is movable forward and rearward within the housing; and a spring attaches at one end to the rear of the housing and at the other end to the cam slider. Engaging jaws mounted on the slider can be locked in the engaging holes, and pin guiding slopes, pin engaging slopes and a pin hole of the engaging jaws are configured to receive an actuating pin fixed at a rear position of a movable rail to lock the opening preventing device at the time of drawing-out of a drawer and to unlock the opening preventing device at the time of drawing-in of a drawer.

5 Claims, 27 Drawing Sheets

SELF-CLOSING AND OPENING PREVENTING DEVICE FOR SLIDE RAILS

Figure 1A:
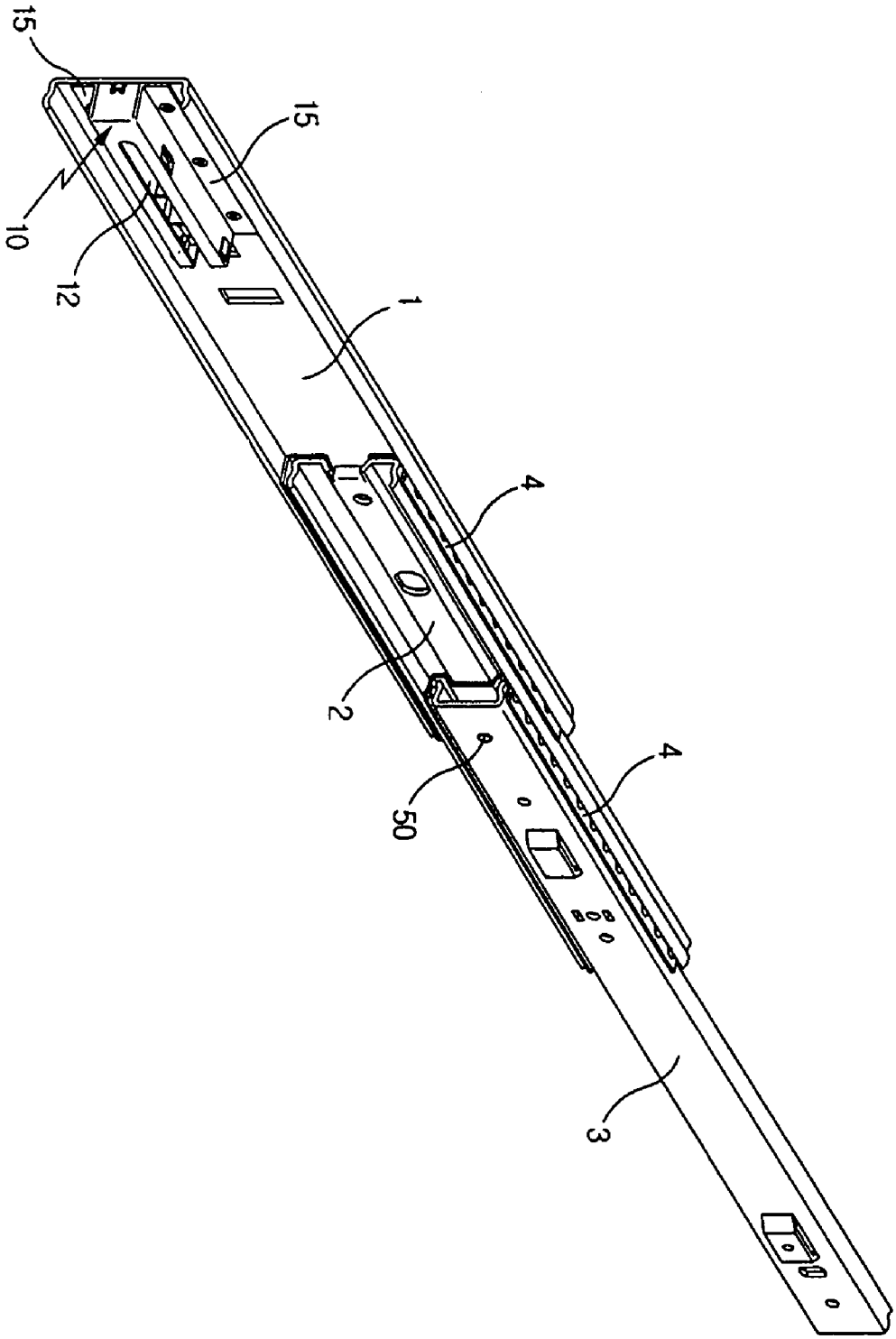

This application claims the benefit of Korean patent application No. 2004-00684153, filed Aug. 30, 2004, which is hereby incorporated by reference in its entirety.

FIELD OF THE INVENTION

The present invention relates to the slide rails installed in various desks, cabinets or drawer-type refrigerators or the like for the purpose of softly drawing-in and drawing-out drawers, and more particularly to a self-closing and opening preventing device for slide rails wherein a drawer is conveniently closed of itself when it reaches a definite point and the drawer is prevented from being opened unnecessarily of itself even by an external shock or vibration.

BACKGROUND OF THE INVENTION

In general, slide rails are installed in a variety of desks, file boxes, cabinets, business furniture, drawer-type refrigerators, drawer-type pickle refrigerators or the like, so that drawers may softly and smoothly be drawn-in and drawn-out when opening or closing the drawers, wherein the slide rails are composed of fixing rails fixed on the both sides of the receiving space of the main body, auxiliary rails assembled inside the fixing rails to be movable back and forth, movable rails assembled inside the auxiliary rails to be movable back and forth, followed by being fixed on the both sides of a drawer and liner bearings mounted between the fixing rails, auxiliary rails and movable rails.

However, because the conventional slide rails so constructed conducted simply the function of softly opening or closing drawers, there was a problem that a drawer was opened unnecessarily of itself when the relevant main body was exposed to a shock or vibration in the state of complete closure of the drawer, with the result that the reliance on the product quality and so the recognition of the product value by consumers were impaired.

Further, the conventional slide rails had the inconvenience of the need for applying manual force until the complete closure of a drawer due to the constructive problem. Additionally, there was another aesthetic problem because the drawer was often opened again of itself due to the repulsive force when the drawer was closed with a temporary large thrusting force.

Particularly, in the case of drawer-type refrigerators or drawer-type pickle refrigerators, when a drawer (storage door) holding food stuff fails to maintain the completely closed state and is opened of itself by a shock or the like, because of the flaws with the conventional art, as described above, the food stuff tends to be spoiled due to the coldness leakage, causing the loss in the electric power. In other words, generally the conventional slide rails had the problem of being impossible to maintain the closed state, because the drawer is opened of itself even when the drawer is completely pushed and so completely closed by a user, due to various constructional factors.

SUMMARY OF THE INVENTION

The object of the present invention is to resolve the disadvantage with the conventional art as described above and therefore to provide a self-closing and opening preventing device for slide rails wherein a drawer is conveniently closed of itself when the drawer is pushed to a certain point without closing it completely by giving to the slide rails the self-closing function, and a drawer in the state of closure is prevented from being opened unnecessarily of itself as by a shock or vibration to maintain the state of being closed always by giving to the slide rails the opening preventing function, with the result that the convenience and reliance on the product quality can be provided to users, simultaneously improving the value of the inventive slide rails as the product.

The above-described object is achieved according to an aspect of the invention by improved slide rails wherein a housing formed with engaging holes and long pin guiding holes is fixed to the rear locations of fixing rails, a cam slider is built inside the housing so as to movable back and forth, the both ends of a spring are connected to the rear position of the housing and the cam slider, a set of opening preventing device formed with engaging jaws, pin guiding slopes, pin engaging slopes and a pin hole is pivotally connected to the inside of the cam slider via shaft pins and an actuating pin is fixed to the rear position of a movable rail to lock the opening preventing device at the time of drawing-out and unlock the opening preventing device at the time of drawing-in.

BRIEF DESCRIPTION OF THE INVENTION

Figure 1B:
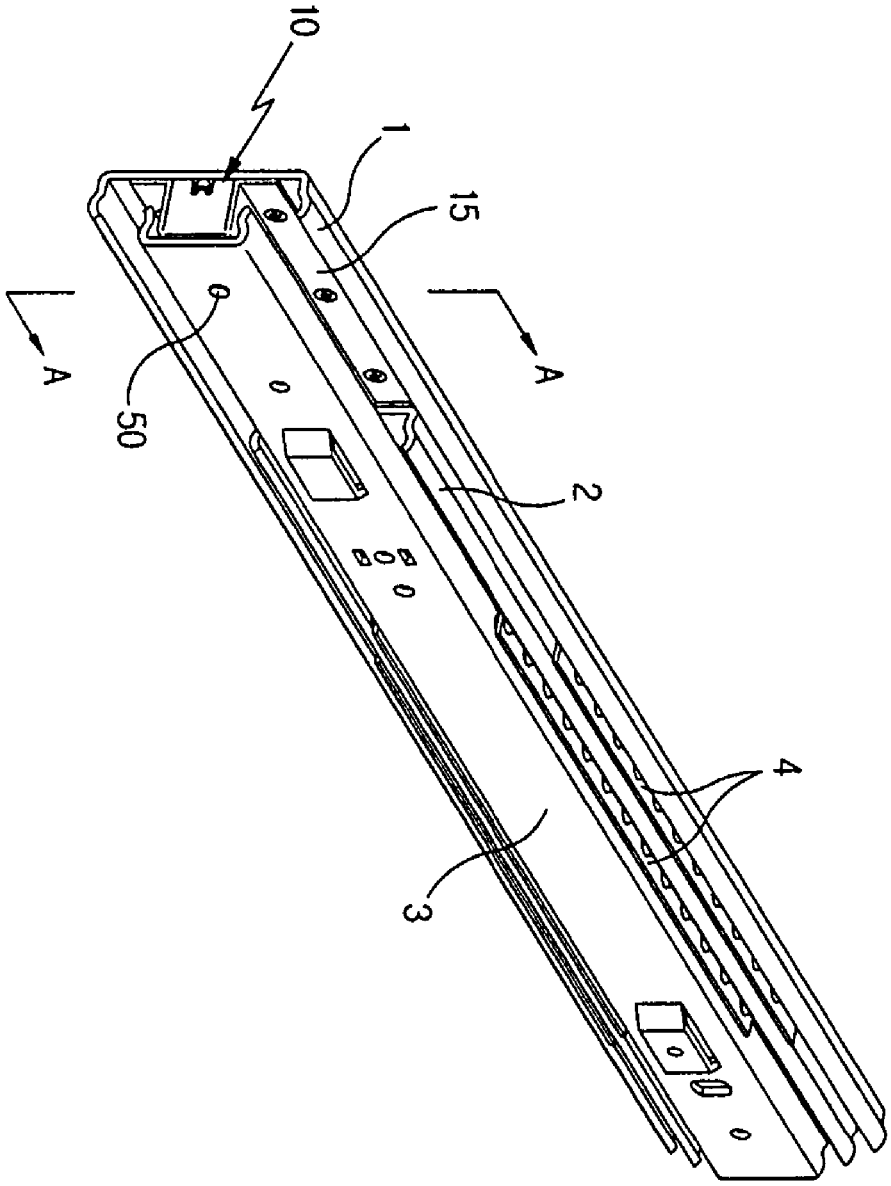
Figure 1C:
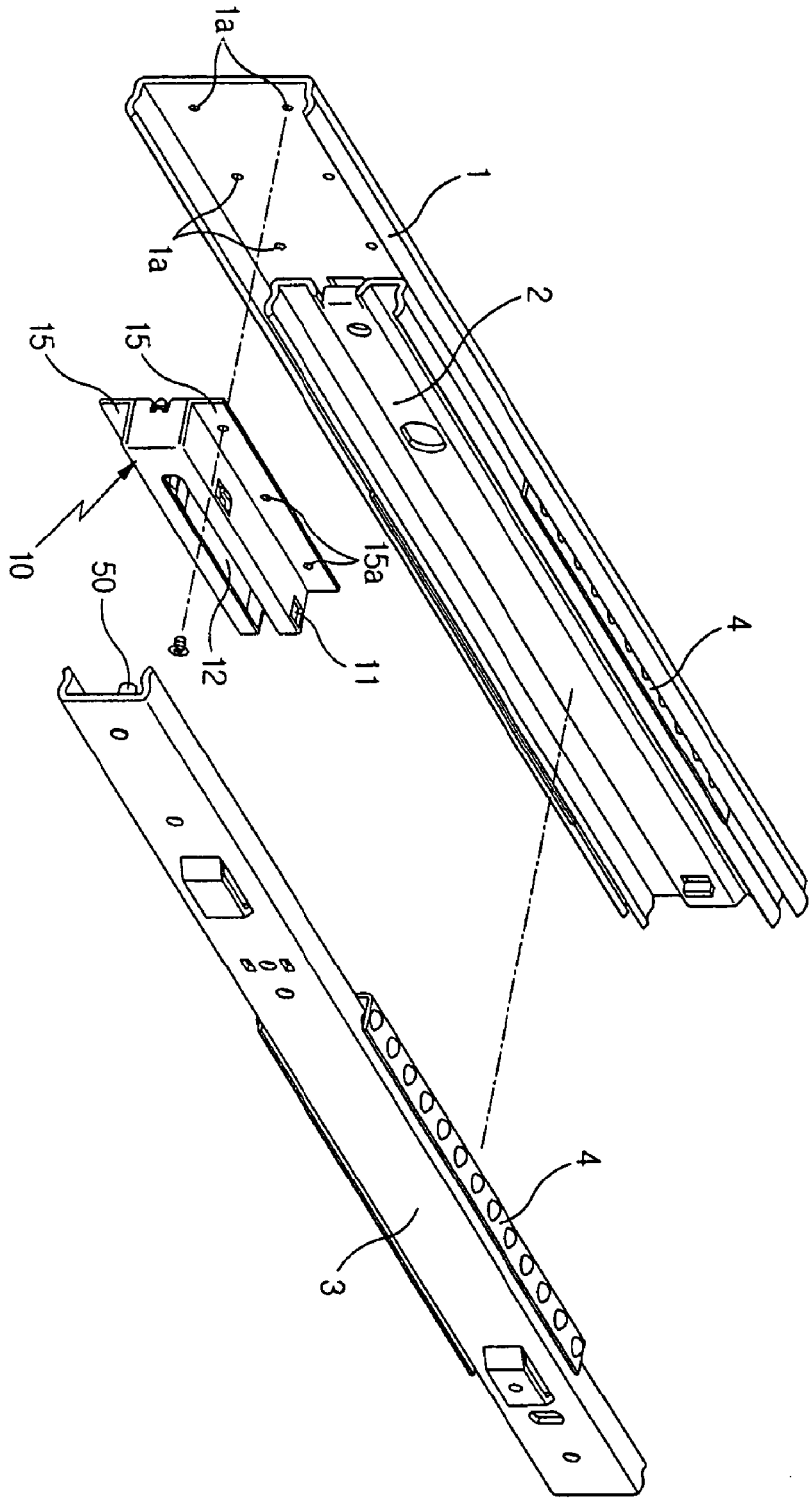
Figure 2:
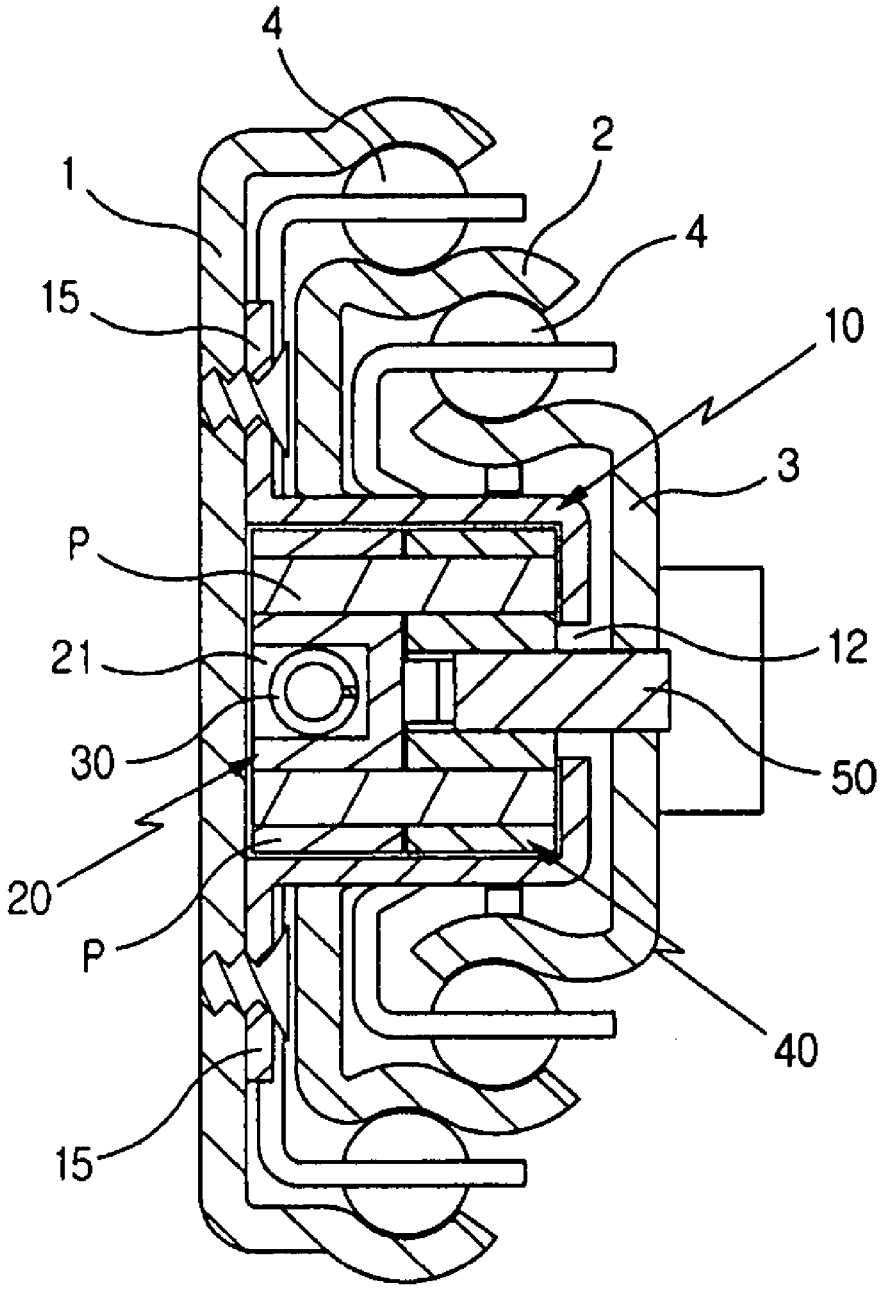
Figure 3A:
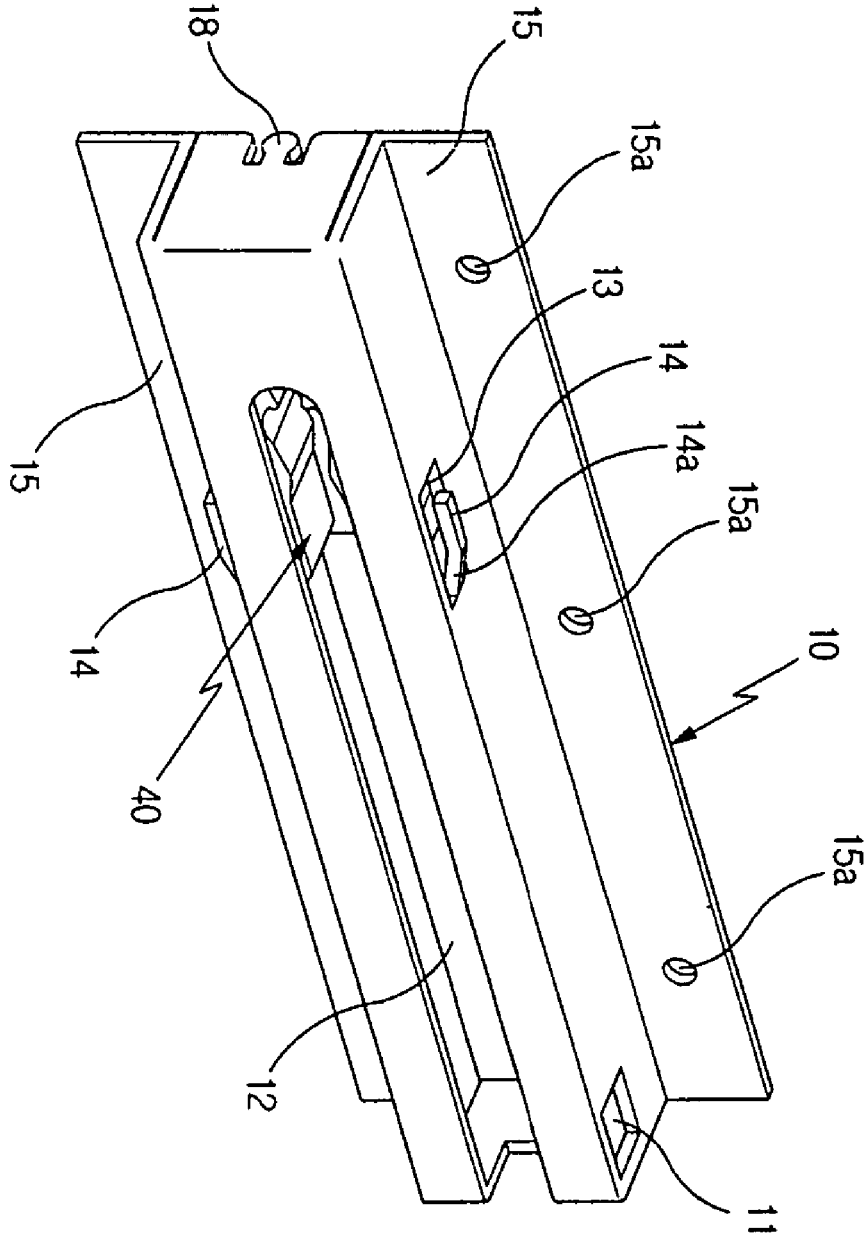
Figure 3B:
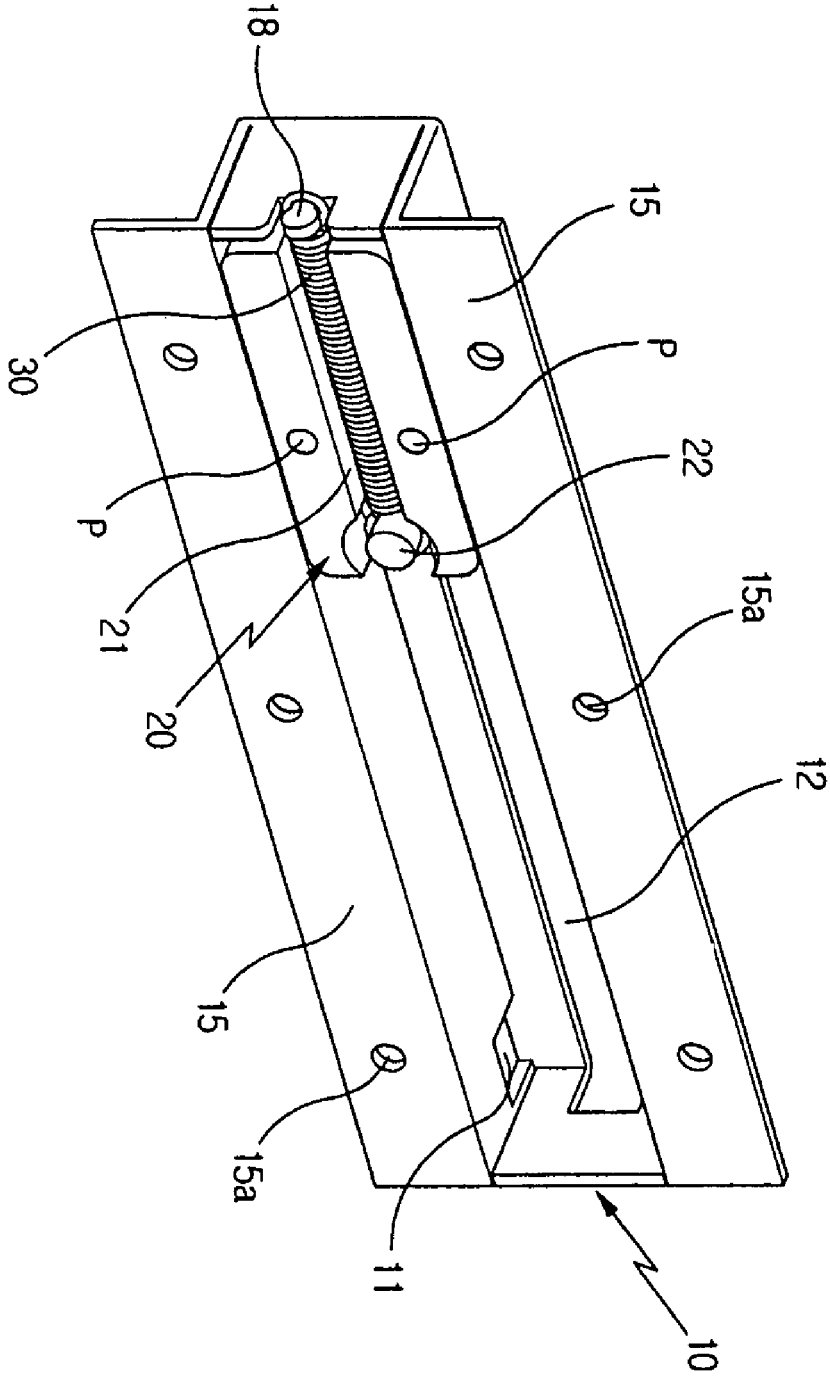
Figure 3C:
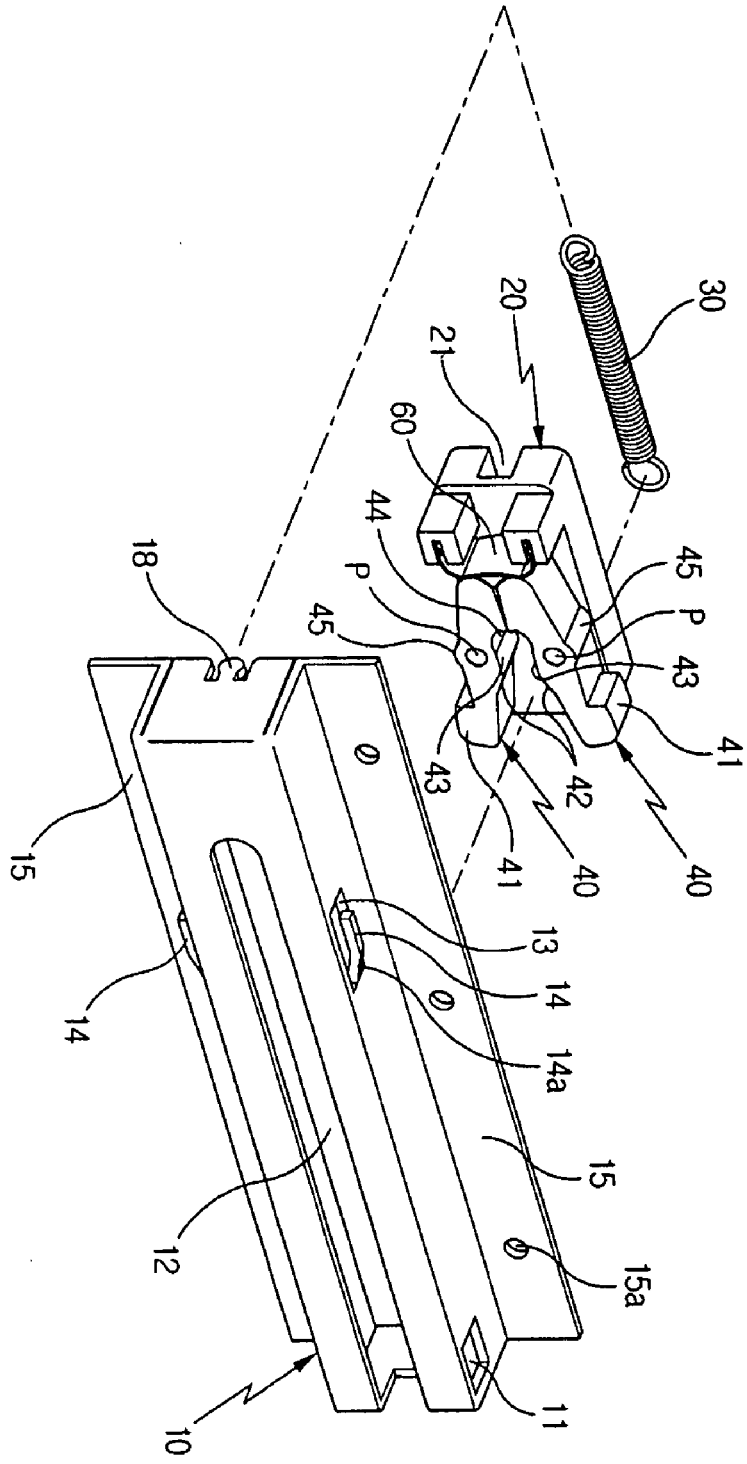
Figure 4A:
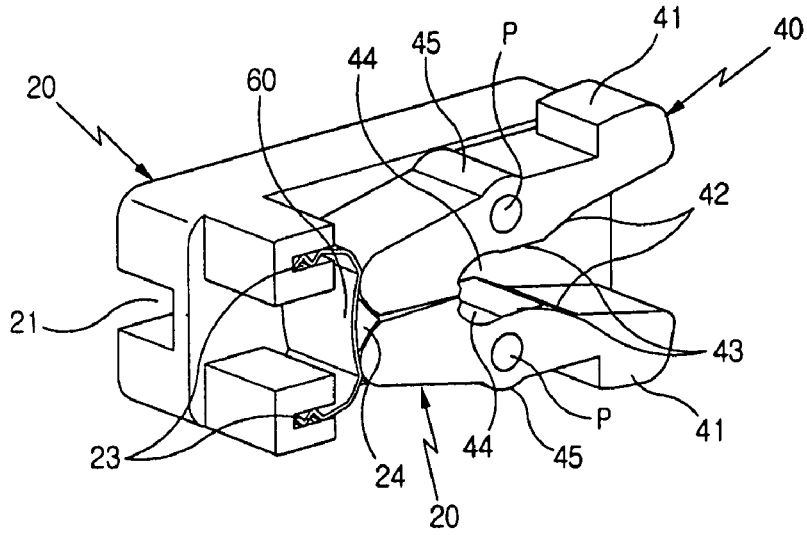
Figure 4B:
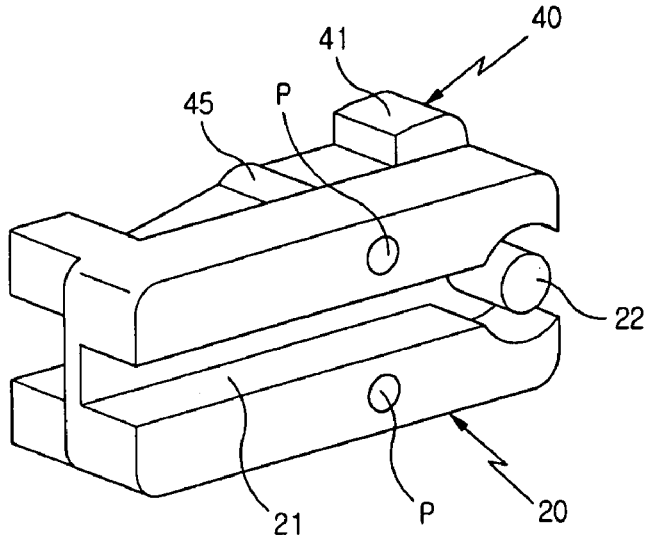
Figure 4C:
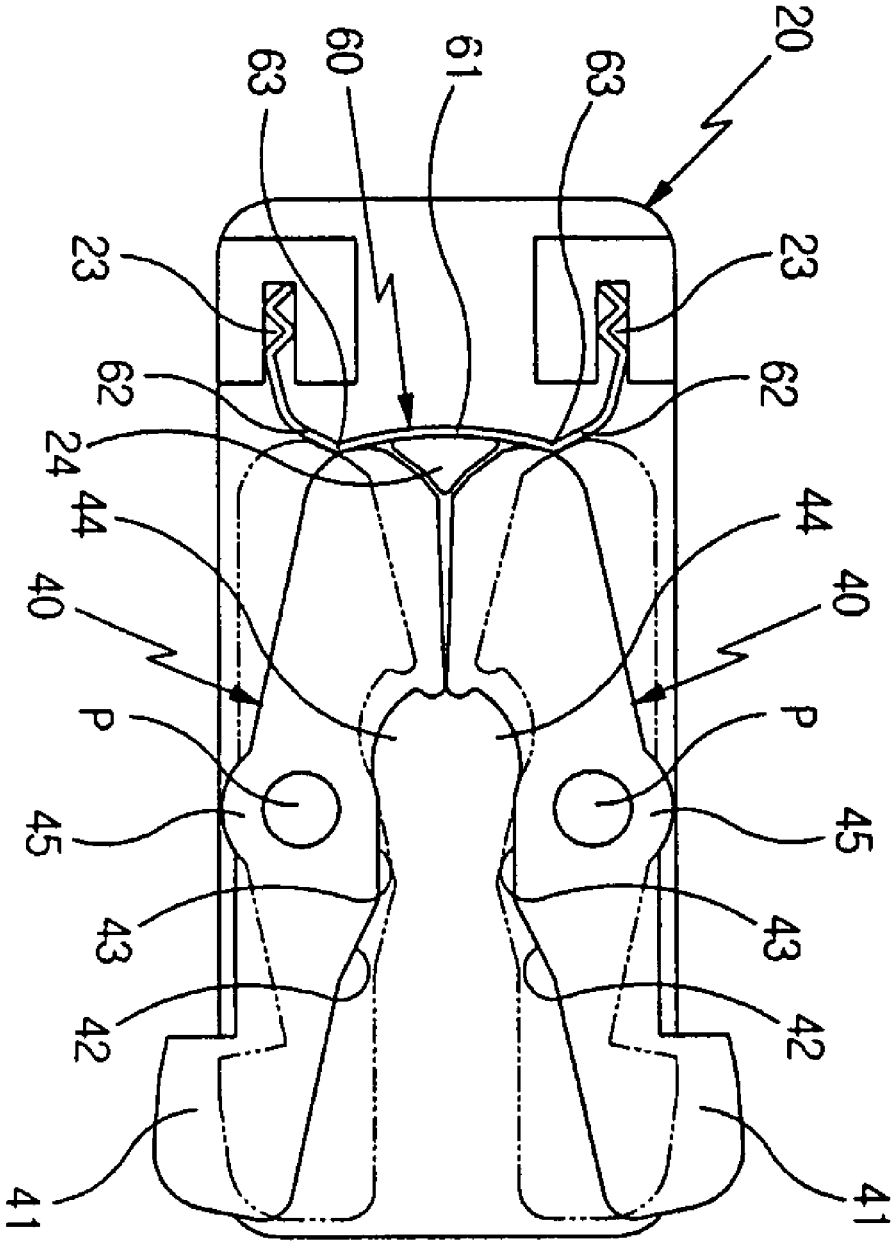
Figure 4D:
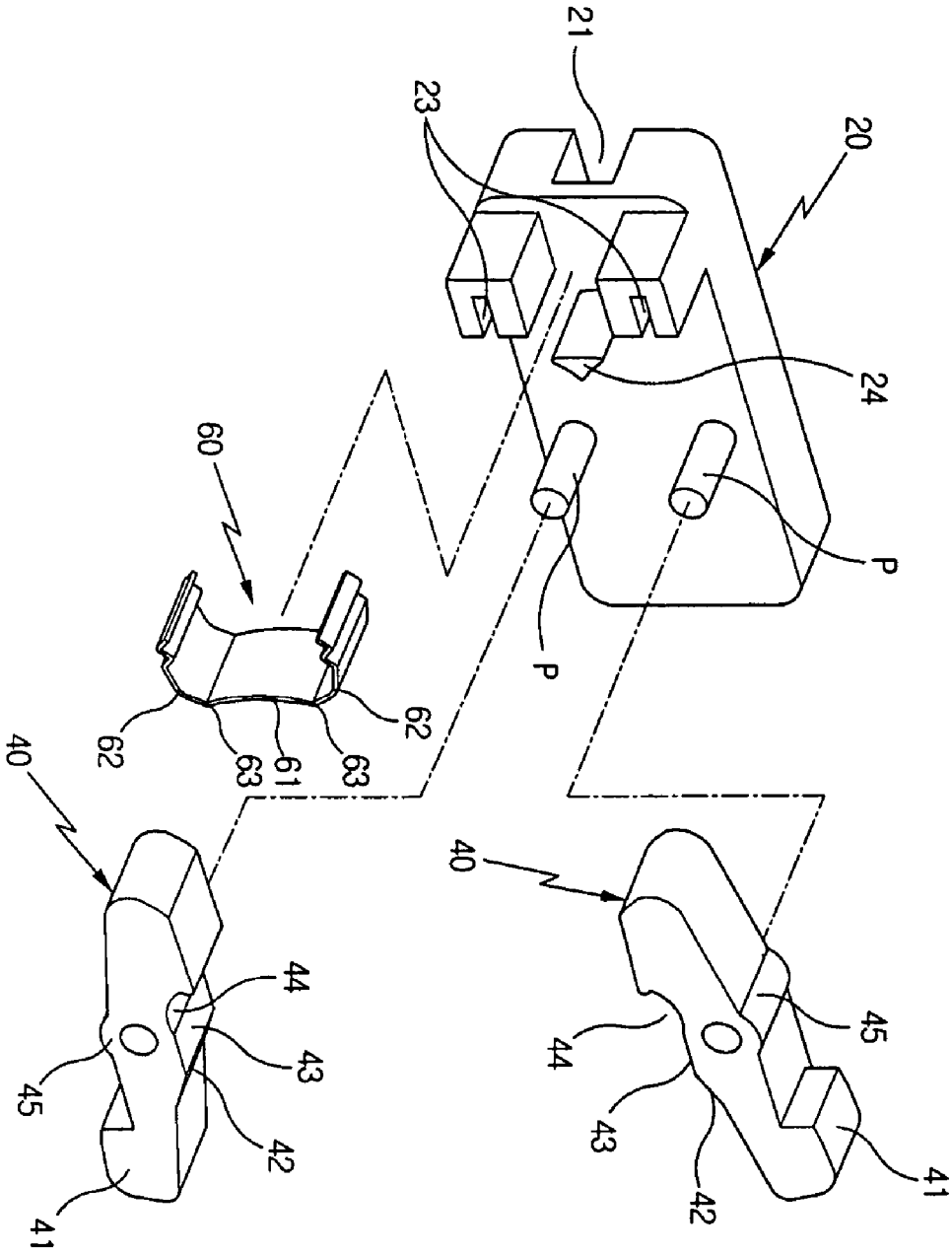
Figure 5A:
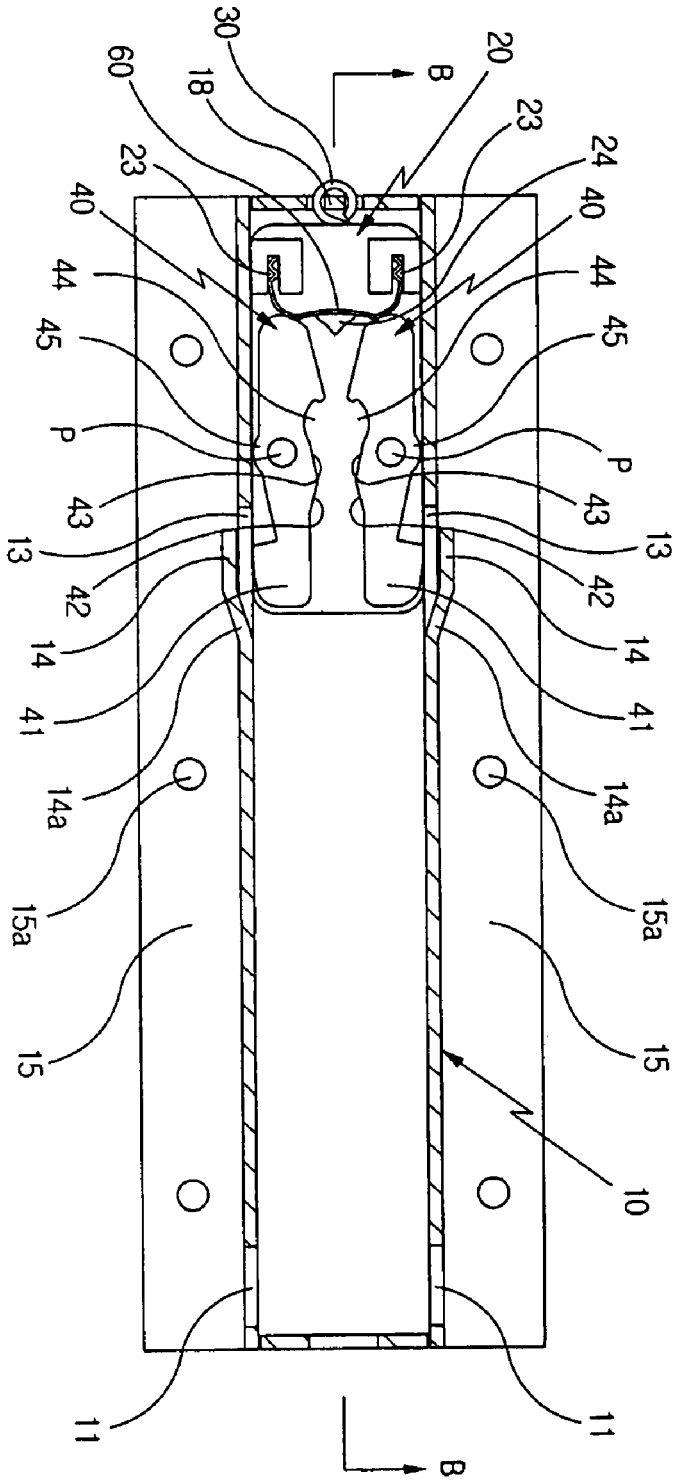
Figure 5B:
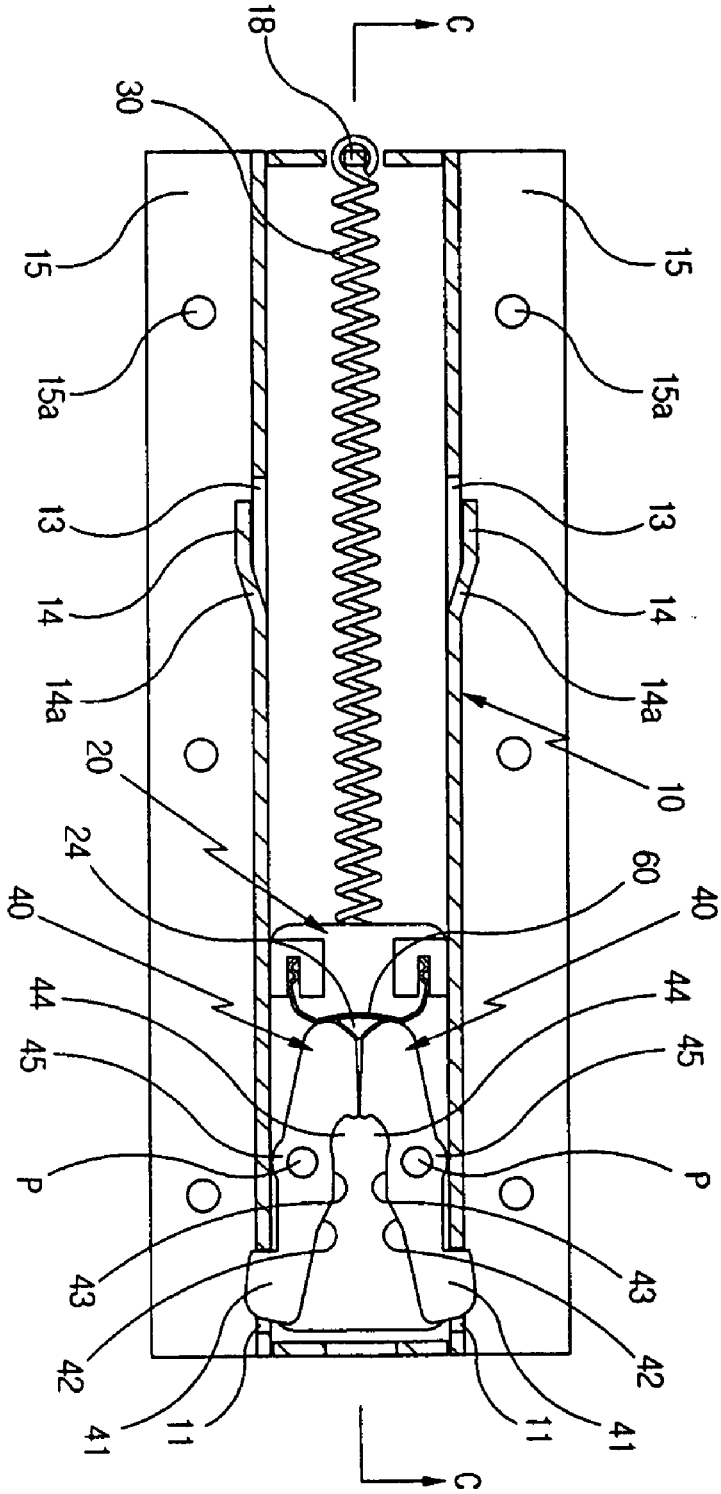
Figure 6A:
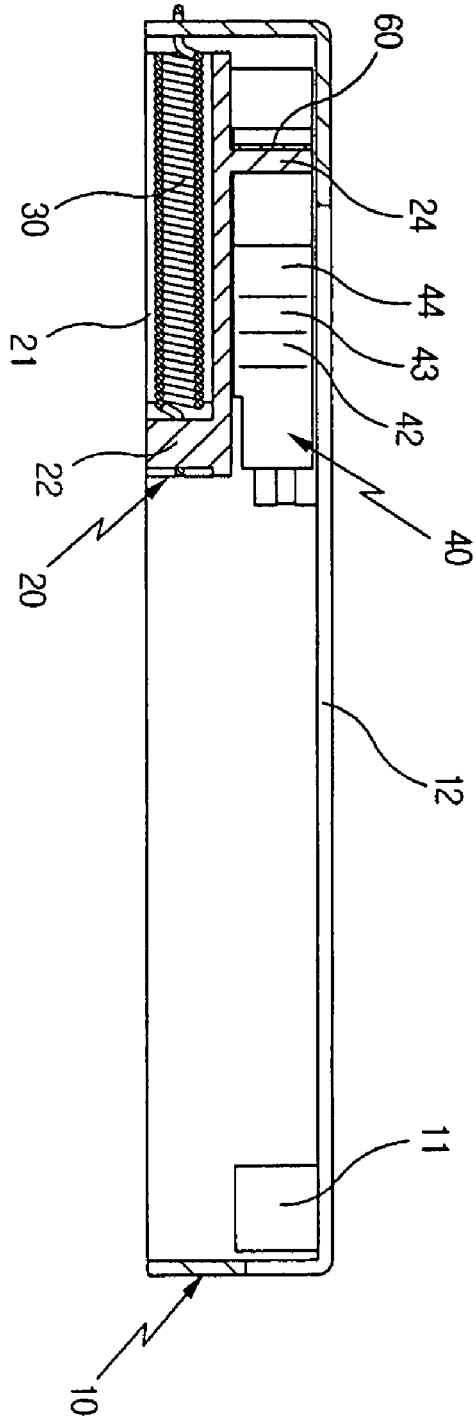
Figure 6B:
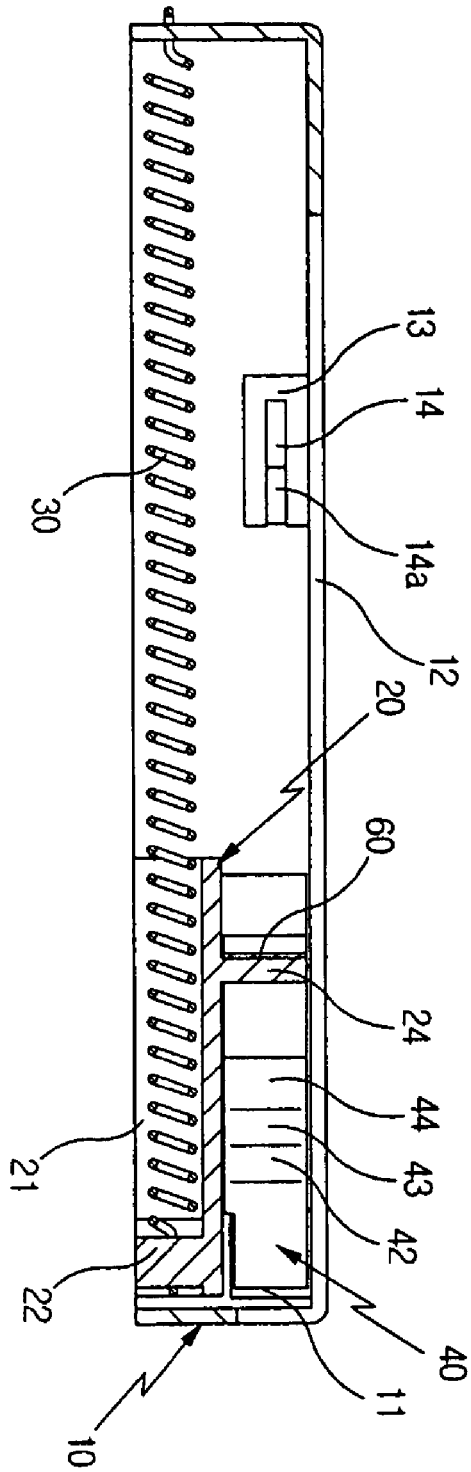
Figure 8A:
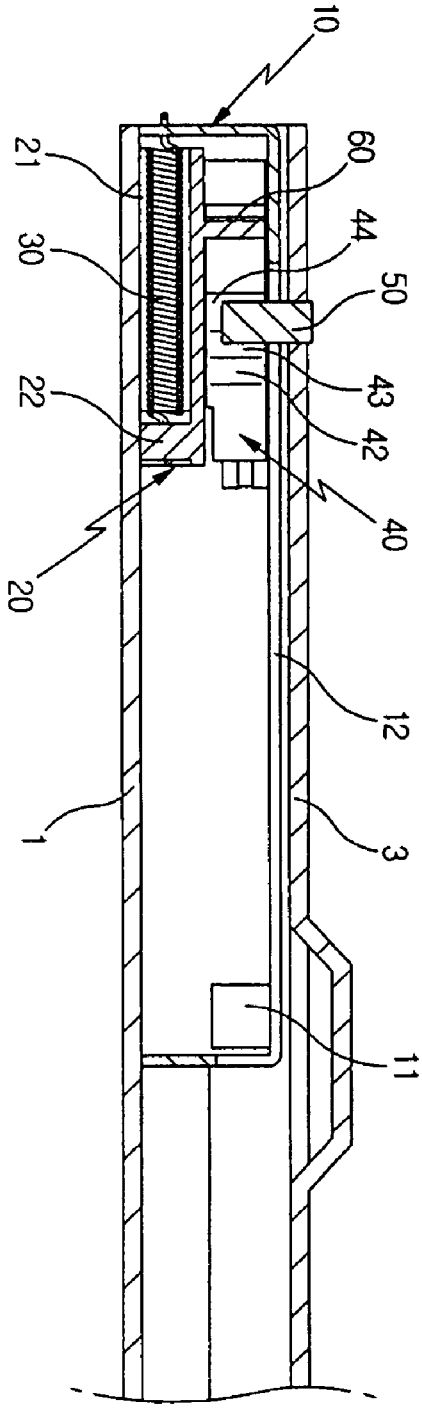
Figure 8B:
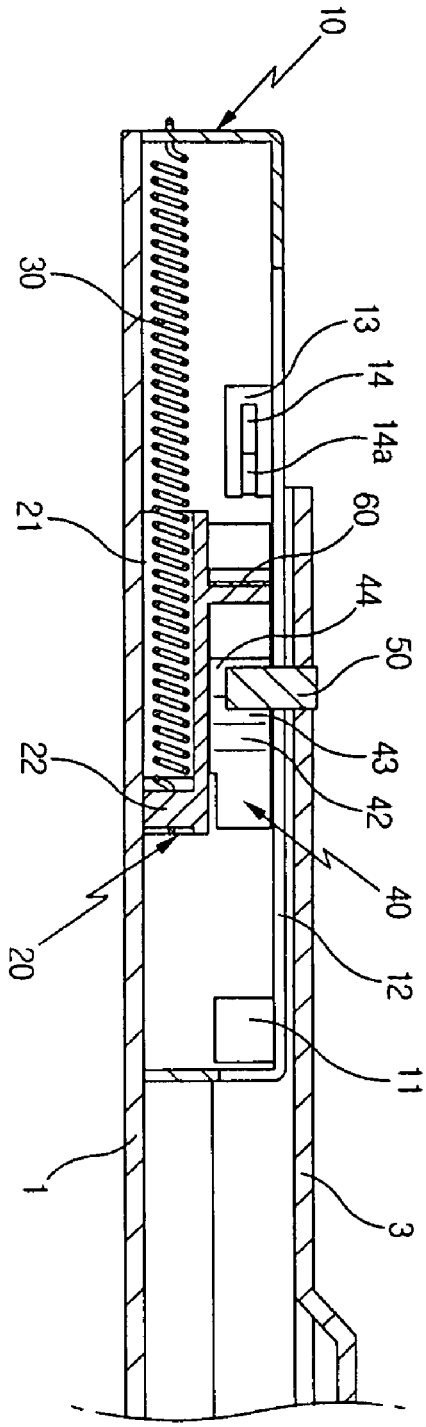
Figure 8C:
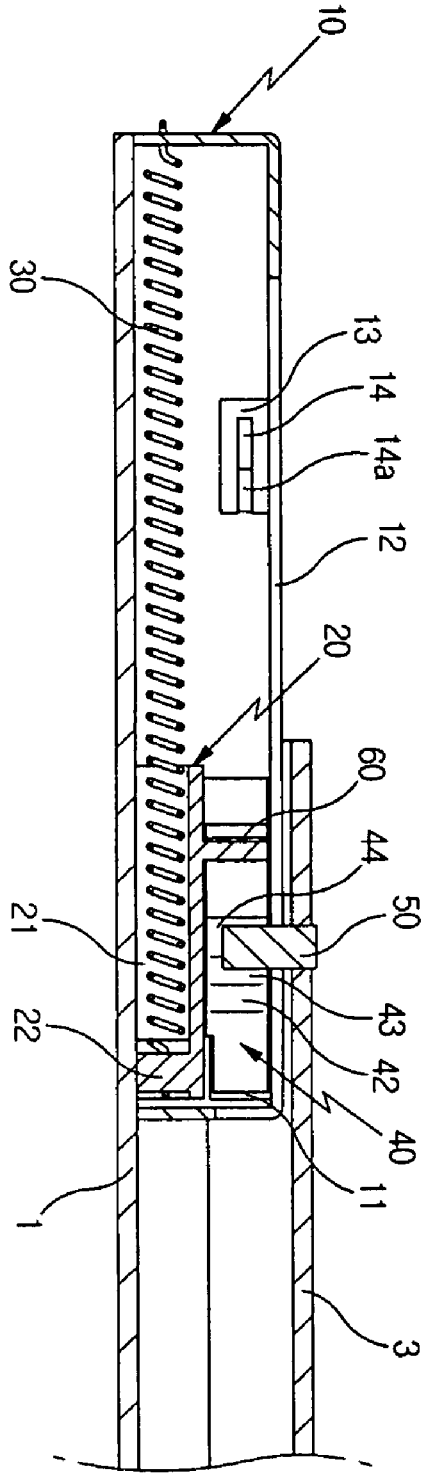
Figure 8D:
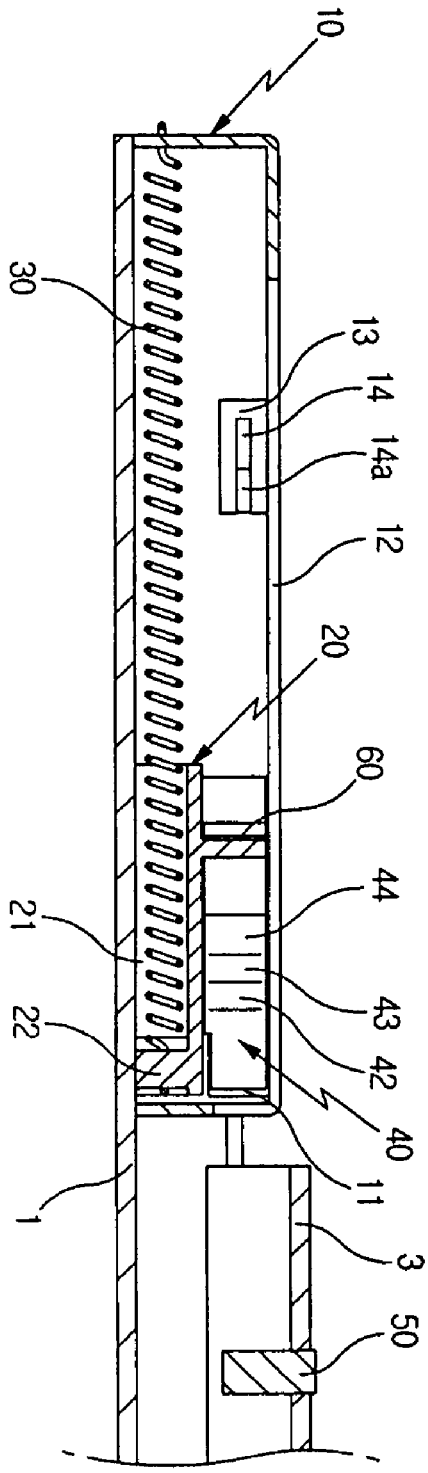
Figure 9A:
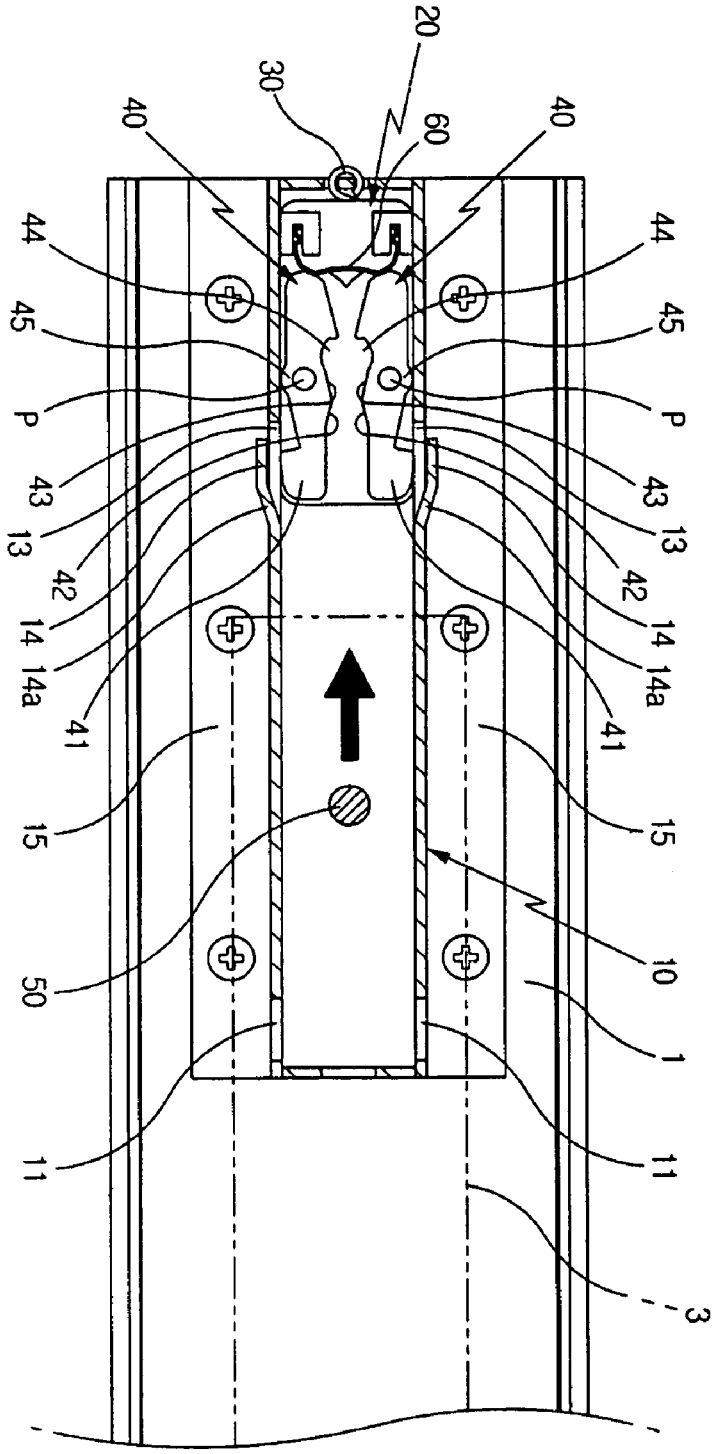
Figure 9B:
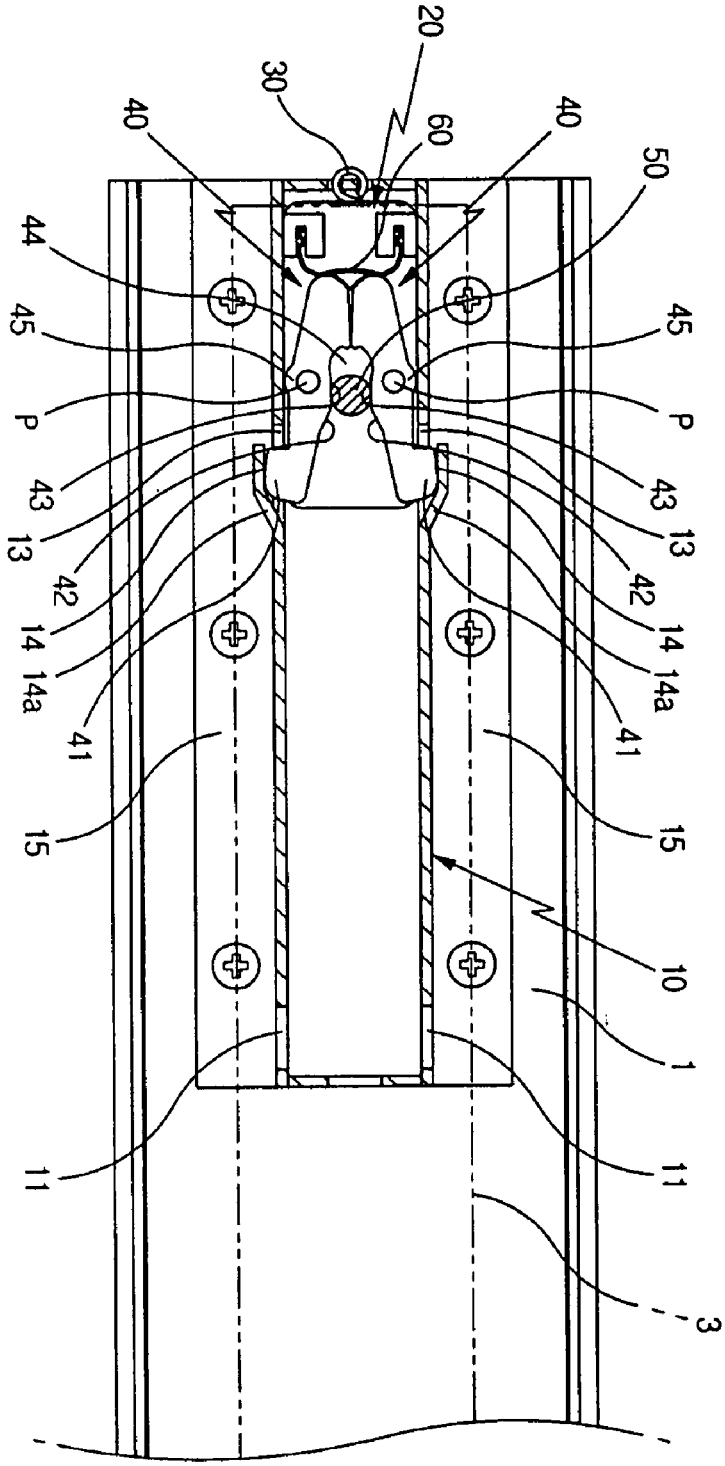
Figure 9C:
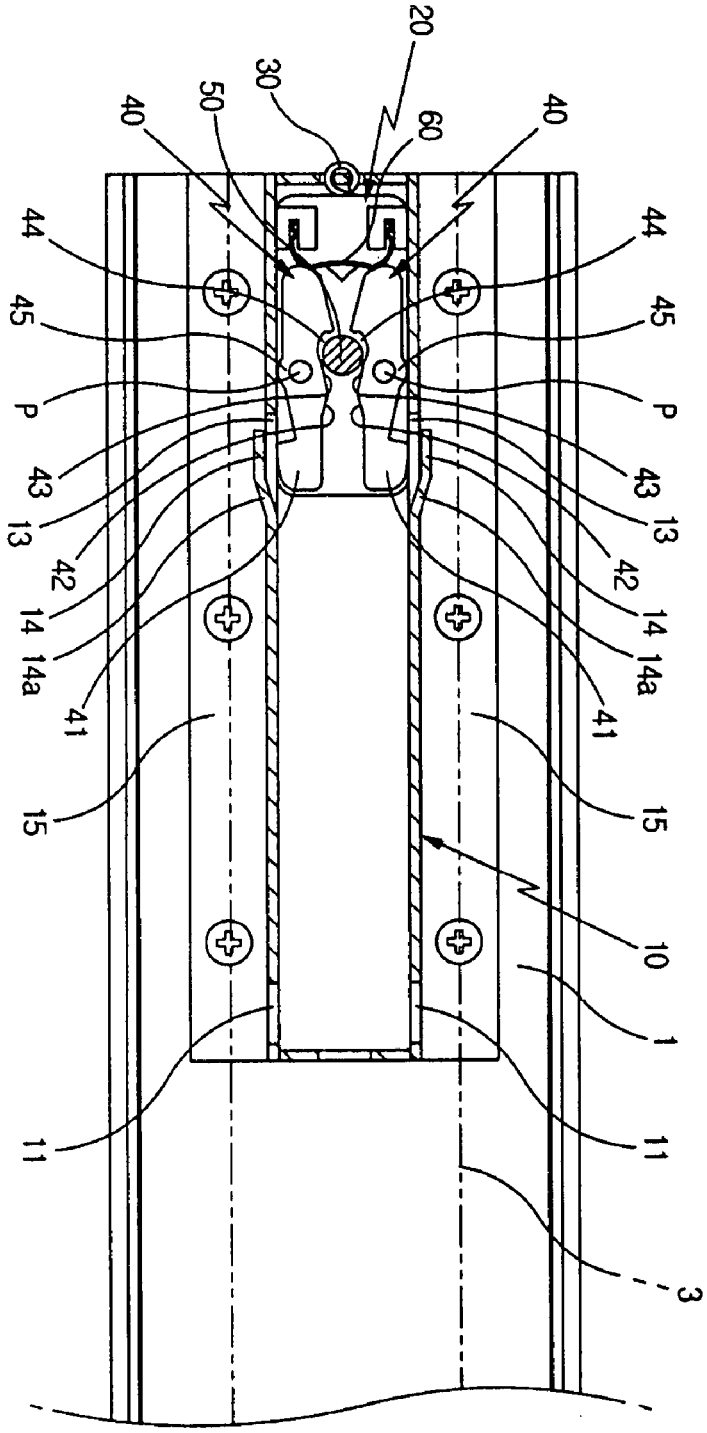
Figure 10A:
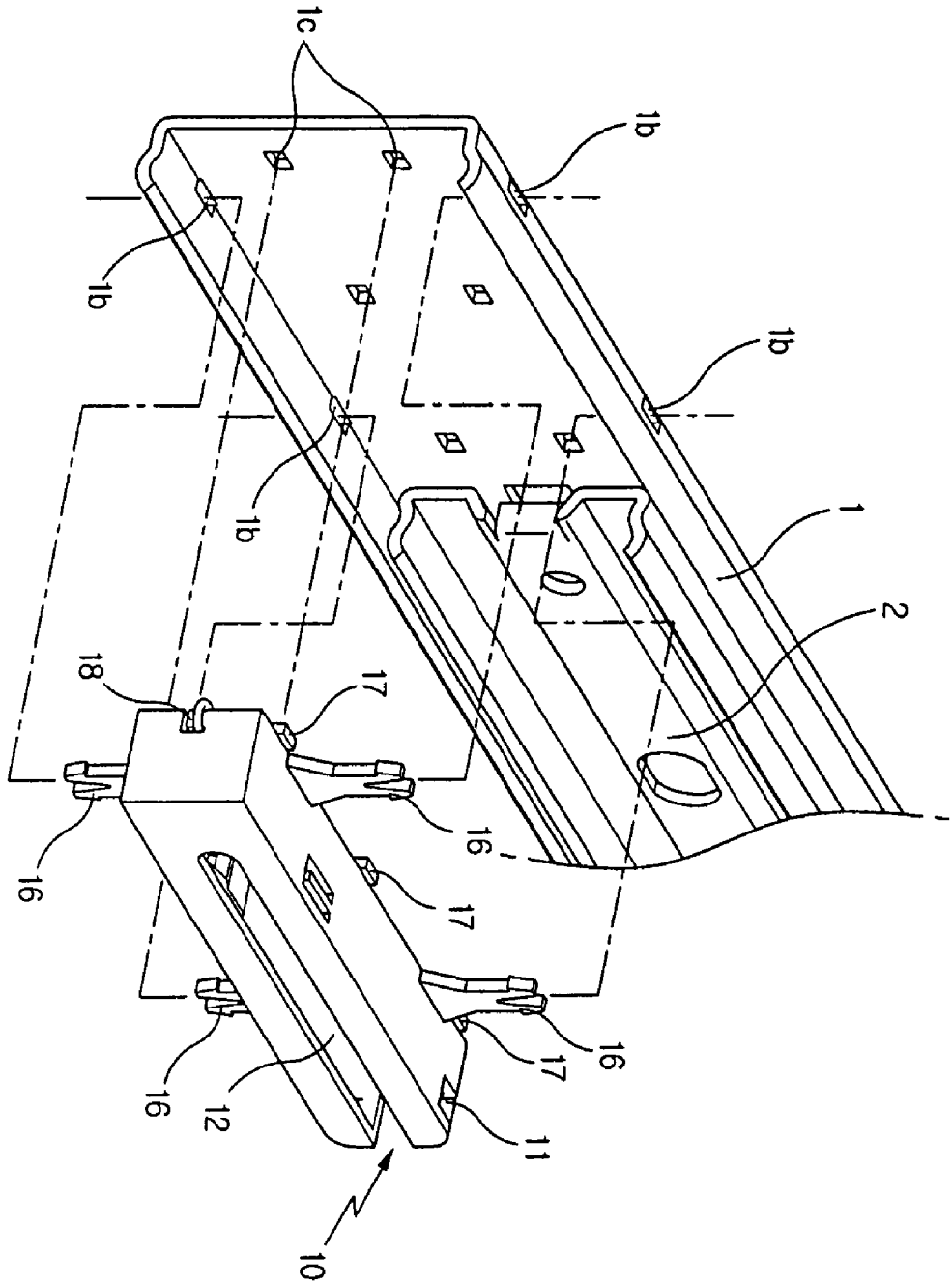
Figure 10B:
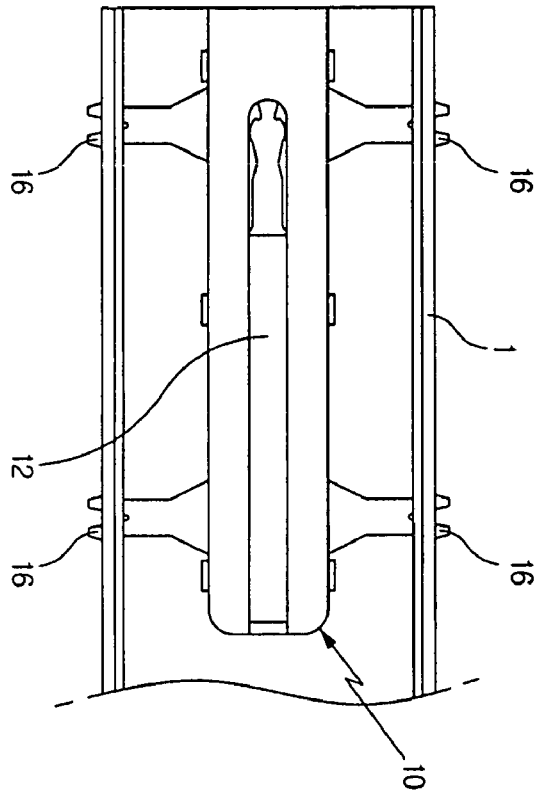
Figure 10C:
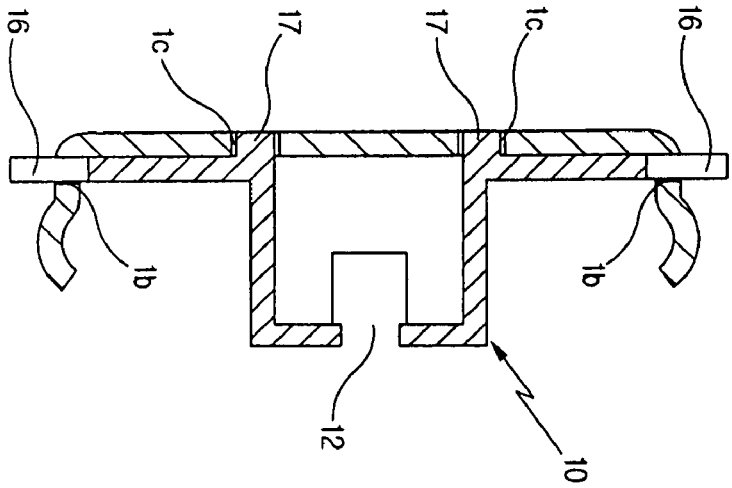

FIGS. 1*a*, 1*b* and 1*c* show the state of the inventive device installed on slide rails, wherein FIG. 1*a* shows the perspective view of the slide rails drawn-out, FIG. 1*b* shows the perspective view of the slide rails drawn-in, FIG. 1*c* shows the exploded perspective view of the slide rails, FIG. 2 shows the enlarged cross section along line A—A of FIG. 1*b*, FIGS. 3*a*, 3*b* and 3*c* show the inventive device, wherein FIG. 3*a* shows the perspective view of the inventive device, FIG. 3*b* shows the perspective view of the back side of FIG. 3*a*, FIG. 3*c* shows the exploded perspective view of FIG. 3*a*, FIGS. 4*a*, 4*b*, 4*c* and 4*d* show the essential parts of the inventive device, wherein FIG. 4*a* shows the perspective view of the opening preventing device of a cam slider according to the invention, FIG. 4*b* shows the perspective view of the back side of FIG. 4*a*, FIG. 4*c* shows the side view illustrating the operational state of FIG. 4*a*, FIG. 4*d* shows the exploded perspective view of FIG. 4*a*, FIGS. 5*a* and 5*b* show the cross sections respectively illustrating the drawn-in state and the locked state of the opening preventing device according to the invention, FIGS. 6*a* and 6*b* respectively show the cross sections of lines B—B and C—C of FIGS. 5*a* and 5*b*, FIGS. 7*a* to 7*d* show the cross sections illustrating the successive operational states of the invention, FIGS. 8*a* to 8*d* respectively show the cross sections of lines D-D to G—G of FIGS. 7*a* to 7*d*, FIGS. 9*a* to 9*c* show the cross sections illustrating the successive operations related with the actuating pin and the guiding holes according to the invention and FIGS. 10*a* to 10*c* show the views illustrating another example of the housing according to the invention.

DETAILED DESCRIPTION OF THE INVENTION

The slide rails in relation with the invention comprise, as shown in FIGS. 1*a* through 10*c*, fixing rails 1, auxiliary rails 2 to be fitted in the fixing rails 1, movable rails 3 to be fitted in the auxiliary rails 2, the movable rails 3 being fixed to a drawer, and liner bearings 4 mounted between the fixing rails 1 and the auxiliary rails 2 as well as between the auxiliary rails 2 and the movable rails 3. In general, the self-closing and opening preventing device for slide rails according to the invention comprises a housing 10 fixed on the rear inside of the fixing rail 1, the housing being formed, on its front upper and lower positions, with engaging holes 11, the housing being formed, on its central part, with a long pin guiding groove 12, the pin guiding groove being open in the front; a cam slider 20 built in the housing 10 to be movable forward and rearward; a spring 30, the both ends of the spring being connected to the rear of the housing 10 and to the cam slider 20; a set of opening preventing device 40 provided, on its front parts, with engaging jaws 41 to be locked in engaging holes 11 and formed, on its inner side, with pin guiding slopes 42 open in the front and pin engaging slopes 43 and a pin groove or pin hole 44, the central part of the opening preventing device being connected to the inside upper and lower positions of the cam slider 20 via shaft pins P; and an actuating pin 50 fixed at a rear position of a movable rail 3, the actuating pin functioning to lock the opening preventing device 40 at the time of drawing-out of a drawer and to unlock the opening preventing device 40 at the time of drawing-in of a drawer.

The technical construction of the invention is described in more detail below by referring to the accompanying drawings.

The auxiliary rail 2 is fitted in the inside of a fixing rail 1 to be movable back and forth, as is known.

The movable rail 3 is fitted in the inside of a fixing rail 1 to be movable back and forth. As is known, such movable rails 3 are fixed on the both sides of a drawer.

The liner bearings 4 are mounted between the fixing rail 1 and the auxiliary rail 2 as well as the auxiliary rail 2 and the movable rail 3 respectively, as is known. These liner bearings 4 function to help the auxiliary rail 2 and the movable rail 3 to be drawn in and out smoothly, when opening or closing drawers, as is known in the art.

On the other hand, although the attached drawings show the invention as applied to a three-stage slide rail composed of the fixing rail 1, auxiliary rail 2 and movable rail 3 for an example, the invention is not restricted to this and so the invention can be applied to a two-stage slide rail composed of the fixing rail 1 and movable rail 3 as well.

The housing 10 having a receiving space is fixed on the inside in the rear of a fixing rail 1, wherein the housing is formed, on its front upper and lower positions, with engaging holes 11 and, on its inner central part, with a longitudinal pin guiding groove 12, the front side of the pin guiding groove being open.

Further, the housing 10 is formed, on its upper and lower positions, with guiding holes 13 for receiving engaging jaws 41 so as to cause an actuating pin 50 to be received in an opening preventing device 40 drawn in, wherein stoppers 14 with slopes 14*a* are formed at the outside of respective guiding holes 13. The guiding holes 13 are formed at positions confronted with the engaging jaws 41 of the opening preventing device 40 drawn in, as shown in FIG. 9*a*.

According to an example of the invention, the housing 10 is formed, on its upper and lower areas, with fixing pieces 15 to be fixed to the fixing rail 1 by means of screw clamping or rivetting, wherein the fixing pieces 15 are formed with a number of clamping holes 15*a*, as shown in FIGS. 1*a* to 3*c*. Clamping holes 1*a* corresponding to the clamping holes 15*a* are formed on the back of the fixing rail 1, as seen in FIG. 1*c*.

Such an example of the invention is characterized in that the housing 10 is fixed to the fixing rail 1 by means of screw clamping or rivetting, wherein the housing 10 is made of a metal.

According to another example of the invention, the housing 10 is formed with a number of hooks 16 on its top and bottom, as shown in FIGS. 10*a* to 10*c*, while the fixing rail 1 is formed, on its rear top and bottom, with hook holes 1*b* for receiving the fixing hooks 16. In addition, the housing 10 and the fixing rail 1 are formed with a number of projections 17 and holes 1*c* respectively for mutual connection.

Such an example of the invention is characterized in that the housing 10 is fixed to the fixing rail 1 by hook clamping, wherein the housing 10 is formed by injection molding with a synthetic resin.

On the other hand, the housing 10 is provided, in its rear, with a spring fixing part 18 for receiving and fixing one end of the spring 30.

A cam slider 20 is housed so as to move back and forth in the housing 10 and influenced by the tension of the spring 30. In the outside middle area of the cam slider 20, a spring groove 21 for receiving the spring 30 is longitudinally formed, wherein a spring fixing part 22 for securing the spring 30 is formed at a front position of the groove 21. At proper positions of the cam slider 20, two shaft pins P are provided to hold a set of opening preventing device 40 in a pivotal manner.

Further, on the rear upper and lower locations, there are formed fixing slots 23, in which a leaf spring 60 is inserted to be in elastic contact with the opening preventing device 40 so as to maintain the engaging jaws 41 in the locked state. The cam slider 20 is formed, at its inner central position, with an escape preventing projection 24 to be in contact with the spring 60 to prevent the escape thereof.

The spring 30 is secured by engaging its both ends with the spring fixing part 18 in the housing 10 and with the spring fixing part 22 in the cam slider 20, wherein the spring 30 urges the cam slider 20 in the rear direction, so that the cam slider 20 may always be in the influence of rearward tension.

The set of opening preventing device 40 is mounted on the shaft pins P of the cam slider 20 pivotally at the approximately central positions of the device, as shown in FIGS. 4*a* to 4*d*, so that the device may be positioned at the inside upper and lower parts of the cam slider 20, so as to conduct a seesaw action. The set of opening preventing device 40 is formed in the mutually confronted arrangement, wherein the device is formed, on its front ends, with the engaging jaws 41 to be fitted in the engaging holes 11 for locking and wherein the insides of the device 40 are formed with pin guiding slopes 42, the guiding slopes being open in the front, pin engaging slopes 43 and pin hole 44.

Such a set of opening preventing device 40 is mounted together with a cam slider 20 movably back and forth on the housing 10, wherein semicircular contacting projections 45 on central points of the opening preventing device 40 project to come into contact with the upper inner and lower inner walls of the housing 10. Accordingly, as appreciated from FIG. 7*b*, the opening preventing device 40 is prevented from a play or rotation during its sliding movement along the inside of the housing, because the horizontal movement is conducted in the state that the engaging jaws 41 and contacting projections 45 of the opening preventing device 40 are in contact with the upper inner and lower inner walls of the housing 10.

Figure 7A:
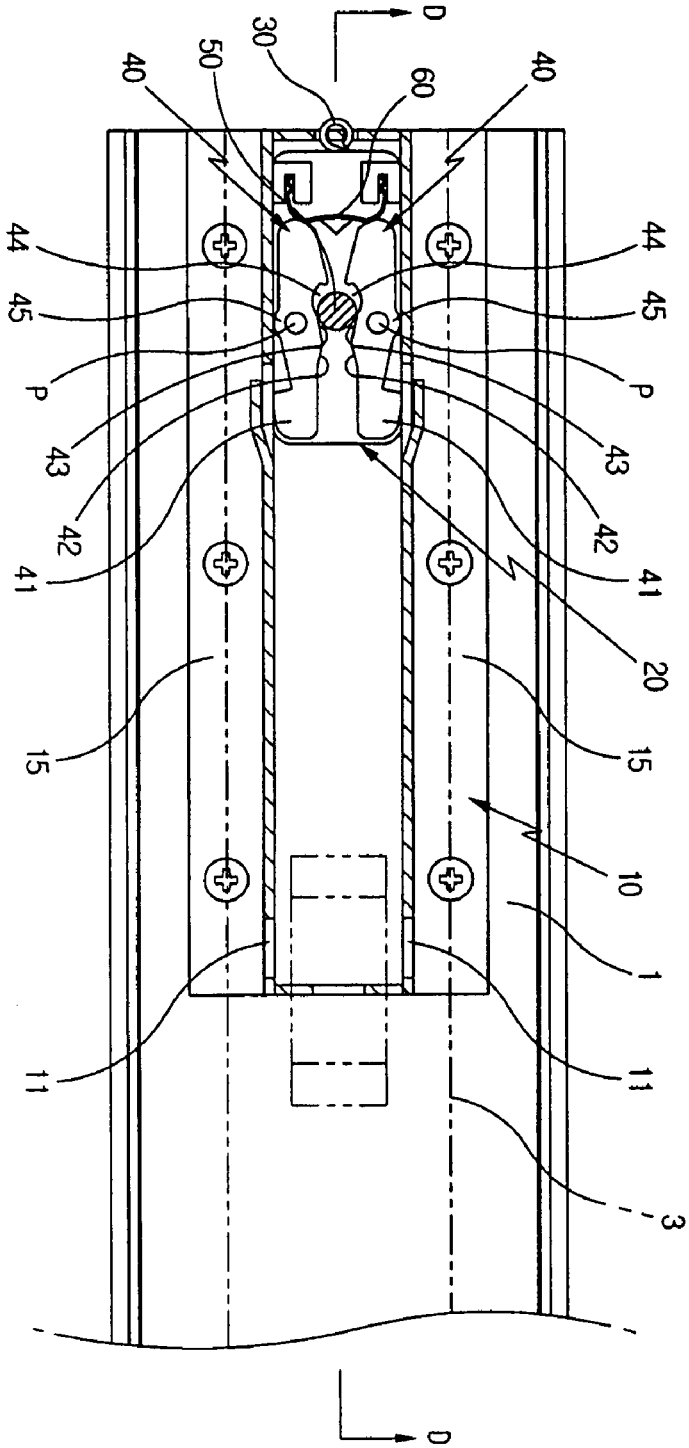

An actuating pin 50 is fixed at a rear position in the movable rail 3, wherein the actuating pin 50 acts to lock the opening preventing device 40 when the slide rail is drawn out while unlocking the opening preventing device 40 when the slide rail is drawn in. As shown in FIG. 7*a*, the actuating pin 50 is assembled in the state that it is received in the pin hole 44 of an opening preventing device 40.

The leaf spring 60 is inserted in the fixing slots 23 of the cam slider 20 to be fixed, the spring contacting elastically the opening preventing device 40 to keep the engaging jaws 41 in the locking state.

In particular, the leaf spring 60 is formed as shown in FIG. 4*c*, wherein a rearward raised curved surface 61 is formed in the middle area of the spring 60, on the top and bottom of which surface, sloped faces 62 are respectively formed, jaws 63 being formed between the curved surface 61 and the sloped surfaces 62.

Accordingly, the rear ends of opening preventing device 40 are normally positioned at the sloped surfaces 62 to provide a horizontal posture, as shown in the imaginary line of FIG. 4*c*, however, the rear ends of opening preventing device 40 are positioned at the curved surface 61, as shown in the solid line of FIG. 4*c*, when the engaging jaws 41 are locked. In the latter state, the opening preventing device 40 can maintain its locked state, because the rear ends of the opening preventing device 40 are detained by the jaws 63 to be prevented from opening or spreading.

The operation of the inventive device constructed as described in the above is described in the below.

First, in the state that the drawer has been completely closed, the auxiliary rail 2 and the movable rail 3 are drawn in within the fixing rail 1, as shown in FIG. 1*b*, simultaneously the actuating pin 50 anchored to the movable rail 3 is inserted in the pin hole 44 of the opening preventing device 40 to maintain the fixed state, as shown in FIGS. 7*a* and 8*a*, and the slide 20 and the opening preventing device 40 keep on being pulled toward the rear under the tension of the spring 30. In this state, the actuating pin 50 is prevented from being drawn out forward due to the inhibiting action of pin engaging slopes 43 of the device 40, because the pin engaging slopes 43 are in the shrunk configuration, as shown in the drawings.

Therefore, when the drawer has been closed completely, the drawer maintains the state of closure due to the tension of the spring 30, as long as the movable rail 3 is pulled forward via the actuating pin 50 by a force exceeding the momentary tension of the spring 30, even when the main body is exposed to a shock or vibration.

Figure 7B:
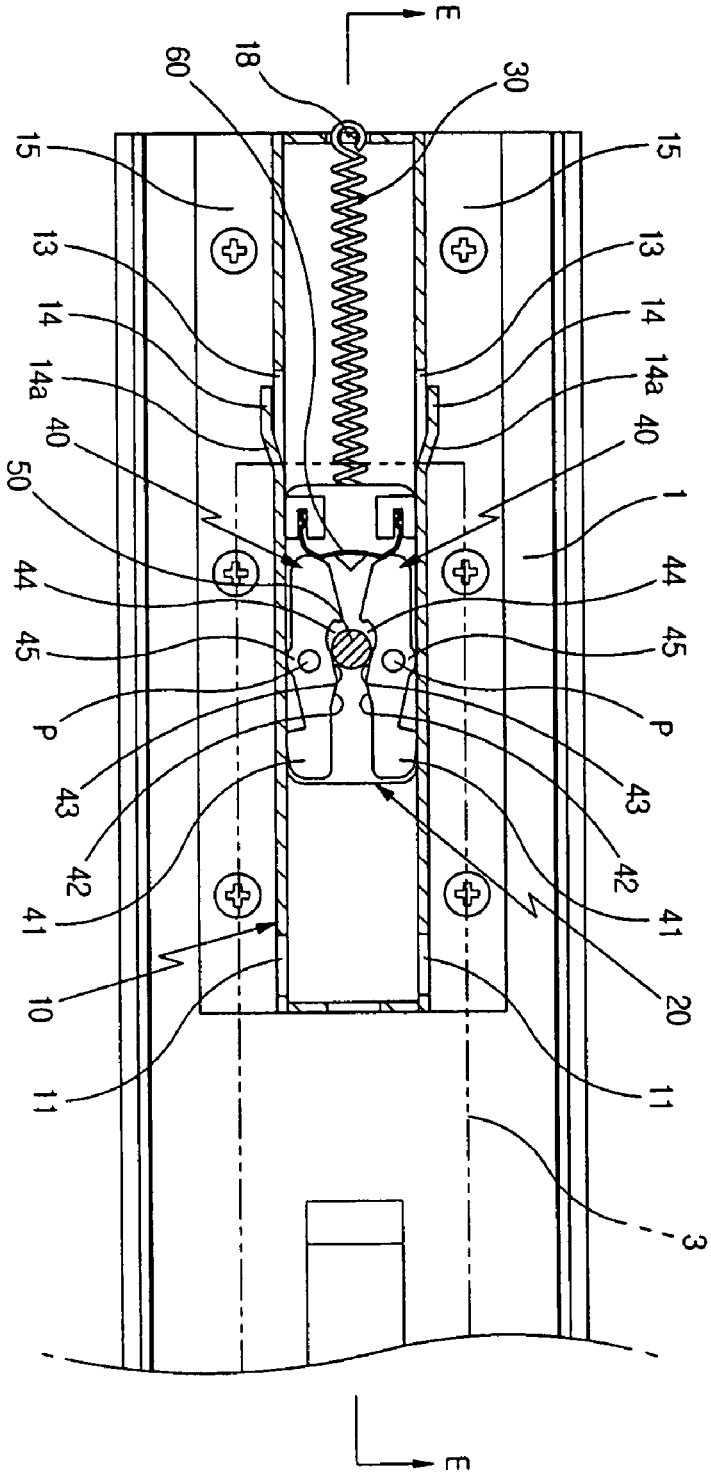

When the drawer is pulled effectively in the forward direction in the state of closure, the movable rail 3 together with the actuating pin 50 is moved forward softly to be drawn out, as shown in FIGS. 7*b* and 8*b*, wherein the opening preventing device 40 is prevented from a play or turning so that the device may not spread within the housing 10 and wherein the actuating pin 50 received in the pin hole 44 of the opening preventing device 40 maintains the state of being gripped by the pin engaging slopes 43. As the result, the opening preventing device 40 catched by the actuating pin 50 moving forward is concurrently moved forward. In other words, the opening preventing device 40 accompanies the movable rail 3 moving forward due to the actuating pin 50 entrapped in the pin hole 44.

The opening preventing device 40 is moved forward by the actuating pin 50, with the result that the cam slider 20 carrying the device 40 is moved forward, pulling the spring 30 forward to expand it.

Figure 7C:
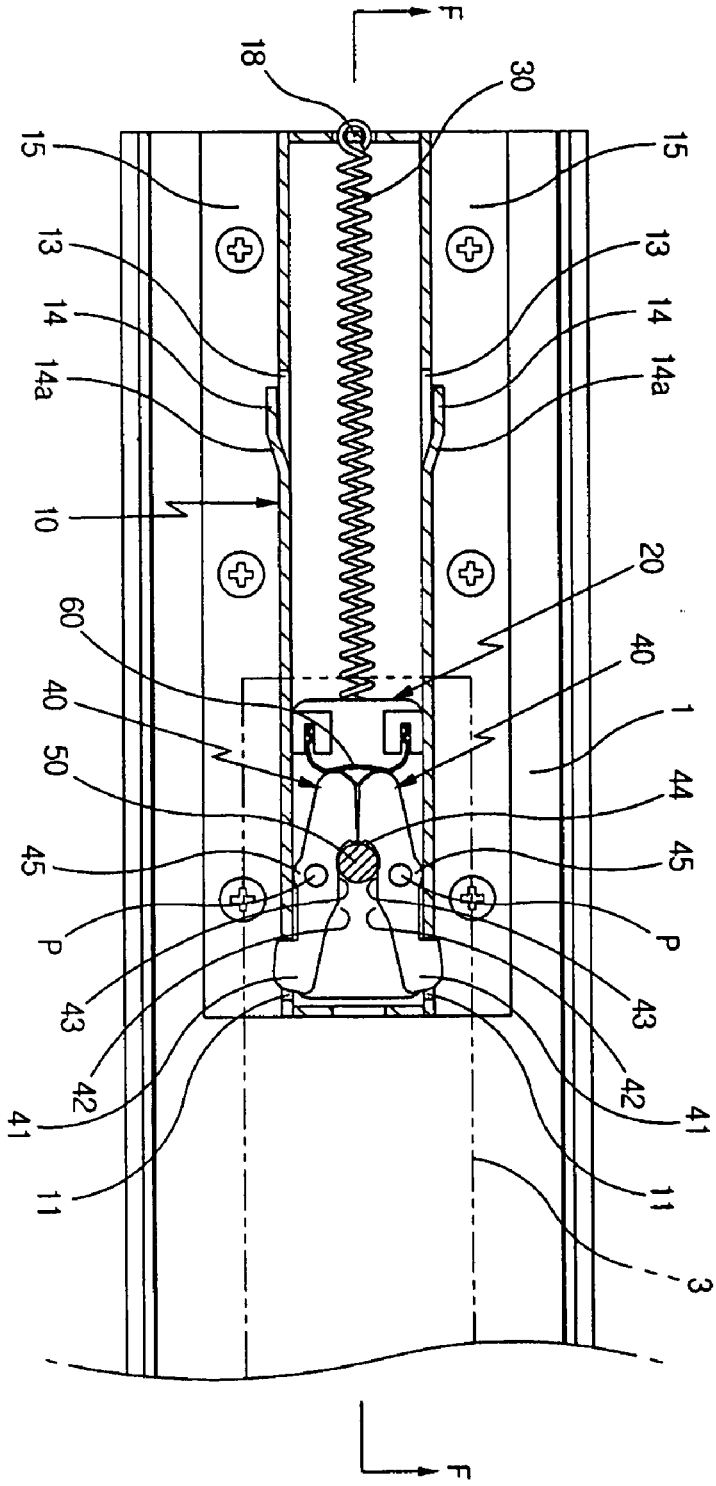

In the course of pulling the drawer forward, the actuating pin 50 together with the opening preventing device 40 continues to move forward, until the engaging jaws 41 of the opening preventing device 40 reach the positions of the engaging holes 11 of the housing 10, as shown in FIGS. 7*c* and 8*c*. On arrival at the positions, the engaging jaws 41 are spreaded by the own elasticity to be inserted in the engaging holes 11 of the housing 10 for locking, and simultaneously the pin engaging slopes 43 of the opening preventing device 40 are opened so as to cause the actuating pin 50 to escape out forward, whereby the opening preventing device 40, now separated from the movable rail 3, is not moved forward but remains in the locked state. In the locked state of the engaging jaws 41 caught in the engaging holes 11, the rear ends of the opening preventing device 40 are caught by the jaws 63 of the opening preventing device 40 to be securely held, resulting in the maintained locked state of the opening preventing device 40, as appreciated from the solid line in FIG. 4*c*.

Figure 7D:
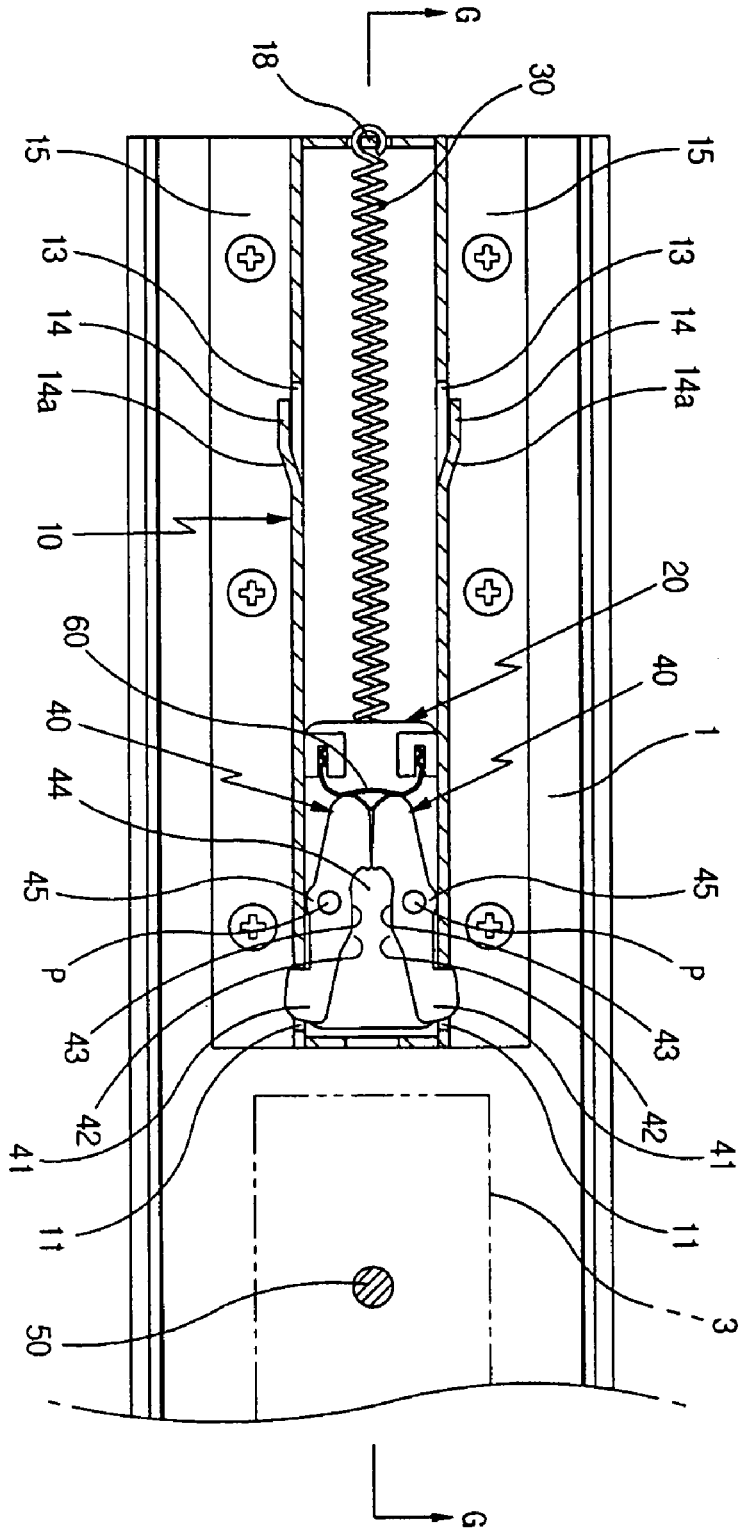

Accordingly, when the drawer is pulled forward continuously, the actuating pin 50 is escaped out of the spreaded engaging slopes 43 to be drawn out forward along the pin guiding slopes 42 open in the front, leaving, however, the opening preventing device 40 engaged with the engaging holes 11 in the locked state, as shown in FIGS. 7*d* and 8*d*, whereby the movable rail 3 with the actuating pin 50 and the auxiliary rail 2 continue to be drawn out forward so as to open the drawer, as is seen in FIG. 1*a*.

On the other hand, when the drawer is pushed rearward to close it, the movable rail 3 with the actuating pin 50 and the auxiliary rail 2 are slowly moved rearward to be drawn in the fixing rail 1, in the reverse procedure of the above, until the actuating pin 50 is caught in the pin hole 44 after moving rearward along the pin guiding slopes 42 and the pin engaging slopes 43 of the opening preventing device 40 in the locked state, and the opening preventing device 40 is continuously under the influence of moving rearward due to the tension of the spring 30, and therefore the engaging jaws 41 are instantly contracted to escape out of the engaging holes 11 to thereby unlock the device 40.

As soon as the opening preventing device 40 is unlocked, this device 40, the cam slider 20 and the movable rail 3 are automatically drawn in rearward by the restoration force of the active spring 30, wherein the actuating pin 50 is unvaryingly in the state of being entrapped in the pin hole 44 of the opening preventing device 40.

Accordingly, if only the drawer is pushed up to the point where the actuating pin 50 of the opening preventing device 40 is engaged with the pin hole 44, the restoration tension of the spring 30, without an external help, causes the opening preventing device 40 to unlock and simultaneously to further move the actuating pin 50 and the movable rail 3 so as to close the drawer completely, wherein the drawer maintains the state of closure without being opened forward even by a shock, vibration or the like thanks to the rearward thrusting tension of the spring 30.

On the other hand, if the opening preventing device 40 is released from the locking at the engaging holes 11 undesirably during use due to a shock or abnormality, in the state that the drawer is closed as in FIGS. 7*a* and 8*a*, and thus if the opening preventing device 40 is fully drawn in rearward in the state that the actuating pin 50 is not engaged in the pin hole 44, as shown in FIG. 9*a*, pushing the drawer rearward further again will cause the actuating pin 50 to slide along the sloped faces 42 of the opening preventing device 40 to be entrapped between the sloped surfaces, as seen in FIG. 9*b*.

A slightly further thrust on the drawer will open the sloped surfaces 42 through the rearward energized actuating pin 50, and simultaneously the engaging jaws 41 of the opening preventing device 40 are opened upward and downward to fit in the guiding holes 13 until the jaws come into contact with the stoppers 14 of the housing 10, as seen in FIG. 9*b*, so that the pin 50 moving rearward can easily get in the pin hole 44. If there were no guiding holes 13 in the housing 10, the engaging jaws 11 would not be opened, with the result that the actuating pin 50 could not get in the groove 44 because the pin guiding slopes 42 and the pin engaging slopes 43 are not possible to open.

When the actuating pin 50 is caught in the pin hole 44, as the drawer is completely closed, as shown in FIG. 9*c*, the engaging jaws 41 inserted in the guiding holes 13 are shrunk to return to the original state to resume the horizontal posture.

Further, the engaging jaws 11 of the opening preventing device 40 are prevented from being caught in the guiding holes 13 when the actuating pin 50 is moved forward in the course of opening and closing the drawer, because sloped members 14*a* are formed in front of the stoppers 14. In other words, the guiding holes 13 impose no influence on the action of the engaging jaws 41 during opening or closing the drawer.

Accordingly, the inventive device constructed as above maintains firmly the state of closure by the tension of the spring 30 when the drawer is completely closed, so that the drawer is not opened by itself during use even if a shock or vibration is applied to the main body of an appliance in use. As the result, the reliance on quality can be given to consumers, increasing the value of commodity.

Furthermore, the invention is so constructed that pushing the drawer rearward up to the point where the opening preventing device 40 is unlocked, without applying force until the complete closure of the drawer, leads to the release of the locking and simultaneous self-closure of the drawer under the restoration force of the spring 30. Besides, even when the closure of the drawer is conducted with a temporary strong thrust, the opening of the drawer due to the repulsion does not take place, whereby neat and tidy appearance is not impaired.

Because the drawers holding food stuff, specially in the case of the drawer-type refrigerators or drawer-type pickles refrigerators, can firmly maintain the completely closed state, according to the invention, or because self-opening of drawers due to a shock or so is prevented to block the leakage of the coldness, the spoiling of food stuff due to the reduced coldness is prevented, in conjunction with the advantage that unnecessary loss in the electric power is prevented.

As described in the above, because the present invention is proved with slide rails with the self-closing function, a drawer can conveniently closed of itself if only the drawer is pushed to a definite point without being closed completely. Because the slide rails of the invention have the opening preventing function, a drawer in the state of closure is prevented from being opened of itself due to a shock or so. In addition, because the state of closure firmly maintained for drawers provides a convenience and reliance on the product quality, the value of the products can be improved.

The invention claimed is:

1. A drawer slide assembly comprising a plurality of slide rails including fixing rails, auxiliary rails fitted in the fixing rails, movable rails fitted in the auxiliary rails, the movable rails being fixed to a drawer, and liner bearings mounted between the fixing rails and the auxiliary rails as well as between the auxiliary rails and the movable rails, wherein each of the slide rails further includes a housing fixed on the rear inside of a resective fixing rail, the housing being formed, on front upper and lower positions, with engaging holes, and on a central part, with a long pin guiding groove, the long pin guiding groove being open in the front; a cam slider built in the housing to move forward and rearward within said housing, a spring having first and second ends, the first end being connected to the rear of the housing and the second end being connected to the cam slider; an opening preventing device provided, on a front part, with engaging jaws to be locked in said engaging holes and formed, on its inner side, with pin guiding slopes open in the pin engaging slopes and a pin hole, the central part of the opening preventing device being connected to inside upper and lower positions of the cam slider via shaft pins; and an actuating pin fixed at a rear position of one of said movable rails, the actuating pin functioning to lock the opening preventing device at the time of drawing-out of a drawer and to unlock the opening preventing device at the time of drawing-in of a drawer.

2. The drawer slide assembly according to claim 1, wherein guiding holes for receiving the engaging jaws are formed at upper and lower positions of the housing to allow the insertion of the actuating pin with the opening preventing device fully drawn-in rearward, and stoppers with sloped members are formed on the outside of the guiding holes.

3. The slide rails according to claim 1, wherein the housing is formed, on its top and bottom sides, with fixing pieces to be fixed to one of said fixing rails by means of screw clamping or riveting.

4. The slide rails according to claim 1, wherein the housing is formed, on its top and bottom, with a number of hooks, while the fixing rail is formed, on its rear top and bottom, with hook holes for receiving the fixing hooks.

5. The slide rails according to claim 1, wherein the cam slider is formed, on its rear upper and lower locations, with fixing slots and in the fixing slots, a leaf spring is inserted to be in elastic contact with the opening preventing device so as to maintain the engaging jaws in the locked state.

* * * * *